United States Patent [19]

Berthiaume

[11] 4,008,038

[45] Feb. 15, 1977

[54] FUEL CONDITIONING APPARATUS AND METHOD

[75] Inventor: Camille J. Berthiaume, Dover, N.H.

[73] Assignee: Columbia Technical Corporation, Braintree, Mass.

[22] Filed: Sept. 10, 1975

[21] Appl. No.: 612,109

[52] U.S. Cl. ..... 431/11; 431/2; 431/4; 431/211; 431/217

[51] Int. Cl.[2] ..... F23D 11/44

[58] Field of Search ..... 431/4, 8, 11, 2, 208, 431/210, 211, 212, 216, 217; 137/566, 567

[56] References Cited

UNITED STATES PATENTS

| | | | |
|---|---|---|---|
| 3,766,942 | 10/1973 | Delatronchette | 431/4 X |
| 3,901,644 | 8/1975 | Armas | 431/217 |
| 3,938,933 | 2/1976 | Armas | 431/4 |

*Primary Examiner*—Edward G. Favors
*Attorney, Agent, or Firm*—Pearson & Pearson

[57] ABSTRACT

An oil burner, heating system has a supplementary system for delivering enriched, flammable, vapor, under pressure, to a vapor burner tip located within the flame pattern produced by the conventional atomized fuel burner tip. The vapor is formed by diverting a portion of the liquid fuel, pressurized by the burner pump, through a coil in the combustion chamber and thence to an outlet below the level of water in a pressure tank. The heated oil bubbles up through the water, and through a layer of oil floating thereon, to the upper portion of the tank for supply to the vapor tip.

12 Claims, 6 Drawing Figures

FUEL CONDITIONING APPARATUS AND METHOD

BACKGROUND OF THE INVENTION

It has heretofore been proposed to supply enriched vapor to an internal combustion engine, by mixing liquid fuel such as gasoline with air, this being the function of the well known carburetor of an automobile. In U.S. Pat. No. 1,121,137 to Schoonmaker of Dec. 15, 1914, the production of such carburated air is achieved by bubbling air up through liquid gasoline in a tank to produce enriched carburated air in the tank.

It has also been proposed to water jacket a gasoline tank by connection to the automobile radiator so that the fuel is heated while air bubbles up to the top of the tank, as in U.S. Pat. No. 1,530,882 to Chapin of Mar. 24, 1925.

However, as far as I am aware, it has not heretofore been proposed to bubble up heated liquid fuel through a layer of water to form an enriched vapor, or fumes, in the upper portion of a pressure tank and to deliver such fumes into the flame pattern of an oil burner to supplement the heat produced thereby.

SUMMARY OF THE INVENTION

In this invention, the conventional oil burner heating system in a home, or other building, continues to include a liquid fuel tank, a heating unit with a combustion chamber, a gun, or other type, oil burner with a burner tip and pump and a fuel line leading from the tank to the burner.

The apparatus and method disclosed herein calls for the interposition of a pressure tank between the fuel tank and the pump with the oil drawn into the pressure tank to form a layer of predetermined thickness therein, and drawn out of the tank to the pump and tip. The layer of oil floats on a layer of water, maintained automatically at a predetermined level in the bottom of the tank. The upper portion of the tank is a vapor chamber, or space.

A portion of the liquid oil is diverted from the pump of the burner under pump pressure to pass through a coil in the combustion chamber, for heating the oil, and is then emitted from a perforated tube outlet below the level of the water in the tank. The heated pressurized bubbles create turbulence while rising through the water layer, and through the oil layer, to form enriched vapor or fumes in the upper portion.

A pump, or any suitable pressure means, delivers the enriched vapor from the pressure tank to a vapor burner tip, located in front of, and just below the level of, the conventional burner tip so as to be ignited thereby and to supplement the heat thereof.

Preferably, in this invention the conventional fuel tank of the heating system is sealed, an air pump, and perforated tube in the bottom of the tank, bubbles air into the top of the tank and this air under pressure is fed to the upper portion of the pressure tank to supplement the enriched vapor therein with pressurized, carburated air.

Thus, the air pump may either be mounted directly on the pressure tank to create pressure therein or it may be mounted on the sealed conventional fuel tank to create pressure therein to drive enriched vapor into the top of the pressure tank and thence to the vapor burner tip.

DESCRIPTION OF THE PREFERRED EMBODIMENT

Figure 1:
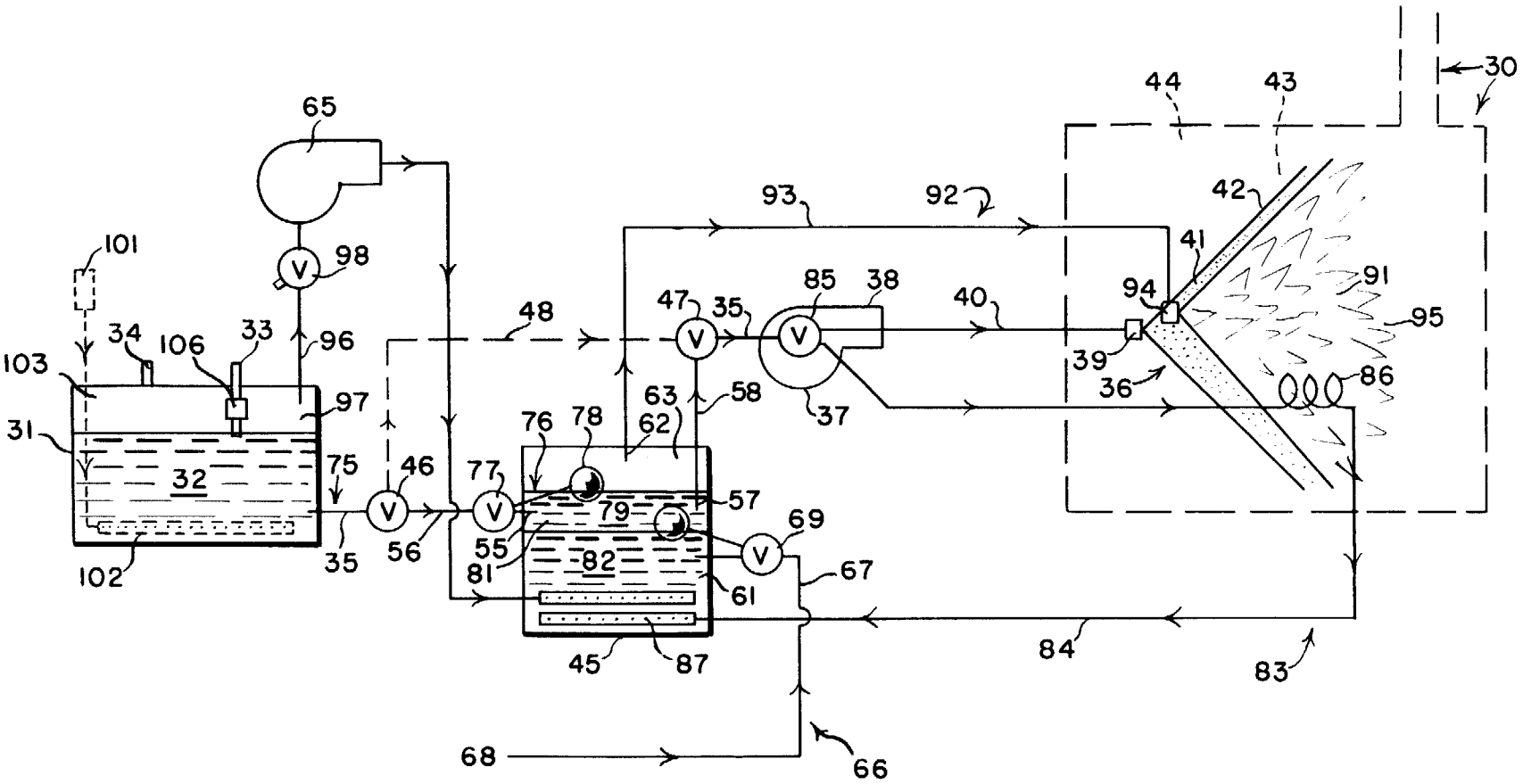
FIG. 1 is a diagrammatic view of the fuel conditioning apparatus of the invention.
Figure 2:
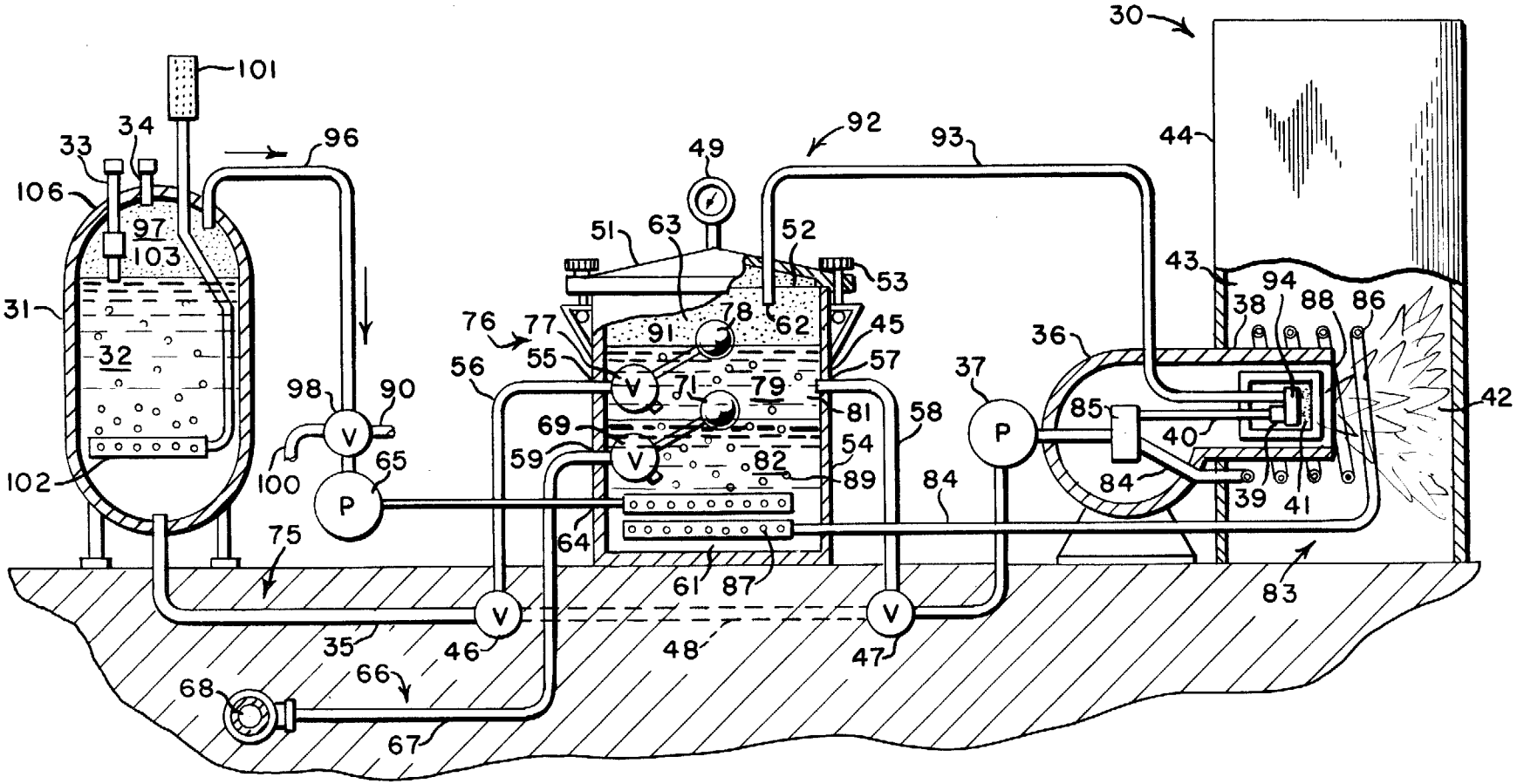
FIG. 2 is a side elevational view of a residence type oil burner system with the apparatus of the invention incorporated therein, parts being broken away and in half section, for clarity.

As shown in FIGS. 1 and 2, the apparatus and method of the invention is incorporated into a typical home heating system 30 of the type having an oil tank 31, usually capable of holding about 200 gallons of liquid oil 32, there being an air vent 33 and a filler pipe 34. A fuel line 35 normally extends to a conventional oil burner 36 having a motorized fuel pump 37, a gun, or barrel, 38, and a burner tip 39. Tip 39 emits atomized fuel 41 in a flame of generally conical configuration, 42, into the combustion chamber 43 of the hot air, hot water, steam or other type heating unit 44, upon call of thermostats, all in a well known manner.

In this invention, a pressure tank 45 is interposed in liquid fuel line 35 by means of valves 46 and 47, so that the portion 48 therebetween may be used, if conventional heat is desired, but portion 48 is bypassed when the supplementary heat of the invention is desired. The line portion 48 is shown in dotted lines for clarity in FIG. 2. A pressure gauge 49 indicates the pressure within tank 48, the pressure being relatively low and about 5 psi. The tank 45 includes a top closure 51 sealed around the peripheral flanges 52, by suitable threaded clamps 53 to the bottom, or base, 54.

Tank 45 includes a liquid fuel inlet 55, connected by conduit 56 to valve 46, for receiving oil from tank 31 and a liquid fuel outlet 57 connected by conduit 58 to valve 47 for delivering oil from tank 45 to the burner 36. Tank 45 also includes a water inlet 59 in the lower portion 61 of the tank and a vapor, or fume, outlet 62 in the upper portion, or vapor chamber 63, of the tank. An air, or vapor, inlet 64 leads from a motorized air pump 65 for feeding pressurized air into the tank 45 to create the desired vapor pressure therein.

Water supply means 66 is provided, including the water pipe 67 connected to a source of water under pressure such as the house main 68 and having a normally closed solenoid valve 69 which is opened to admit water into the lower portion 61 of tank 45 when a signal is received from suitable level sensing means such as a pair of electrodes 71 and 72 in a circuit 73 including the coil 73 of valve 69 and a source of 110-volt current 74. A float valve, photo cell or any other suitable means may be used to maintain a predetermined level of water in tank 45 to form a layer of water of predetermined thickness, or height therein, all in a known manner.

The liquid fuel supply means 75 of the invention includes the oil tank 31, fuel lines 35 and 56, valves 46 and 47, liquid inlet port 55, tank 45, liquid outlet port 57, fuel line 58, liquid fuel pump 37 and the burner tip 39.

Automatic liquid fuel control means 76 is provided in the form of a valve 77 opened and closed by a float 78 riding on the layer of oil 79 in the intermediate portion 81 of tank 45, the layer 79 of oil floating on the layer 82 of water in the lower portion 61 of tank 45.

The vaporized fuel formation means 83 includes a bypass, or recirculation, liquid fuel line 84, leading from the joint 85 in fuel line 58, in rear of the fuel pump 37 and in advance of the burner tip 39, to conduct liquid oil under pump pressure through a pre-heating coil, or jacket, 86, and thence to an outlet 87, preferably in the form of a perforated bubbler tube, in the lower portion 61 of tank 45 below the predetermined level of the water layer 82. The heating coil 86 preferably encircles the gun, or barrel, 38 of burner 36 and extends beyond the end 88 thereof so that some of the convolutions are in the path of the truncated conical flame 42 in the combustion chamber 43. Thus each time the thermostatic, or other, controls of oil burner 36 close the circuit to energize pump 37, liquid fuel under pressure is delivered to burner tip 39 for atomization, ignition and flame. Simultaneously a portion of the pressurized liquid fuel is heated in coil 86 and delivered to the outlet 87 to produce heated bubbles 89 of oil which rise upwardly through the water layer 82 and upwardly through the liquid oil layer 79 to form enriched vapor, or fumes 91 in the upper portion, or vapor chamber, 63, of the pressure tank 45.

The enriched vapor supply means 92 of the invention includes the vapor outlet 62 of tank 45 and the vapor conduit 93 leading to the vapor burner tip 94 which is located in combustion chamber 43 in the path of the flame 42, just in front of, and below the level of, the burner tip 39. Thus the vapor 91 is ignited by the flame 42 to supplement the heat produced by the burner tip and form a flame pattern 95 as shown diagrammatically in FIG. 1.

Vapor pressure of about 5 psi is achieved in the upper portion 63 of tank 45 by the motorized air pump 65 which is in circuit with fuel pump 37 so as to be energized for each period that the fuel pump is energized by the heat controls. As shown air pump 65 may draw fumes through influent conduit 96 from the upper portion 97 of fuel tank 31, or may draw fresh ambient air from the atmosphere by means of two way valve 98. Preferably, however, as shown in dotted lines the tank vent 33 sealed, so that pump 65 draws fresh air from inlet 101, drives the air into a perforated tube bubbler 102 and thereby creates enriched fumes 103 under pressure in the upper portion 97, which pressurized fumes are conducted through line 96 to the upper portion 63 of tank 45, and thence to the vapor burner tip 94.

Figure 3:
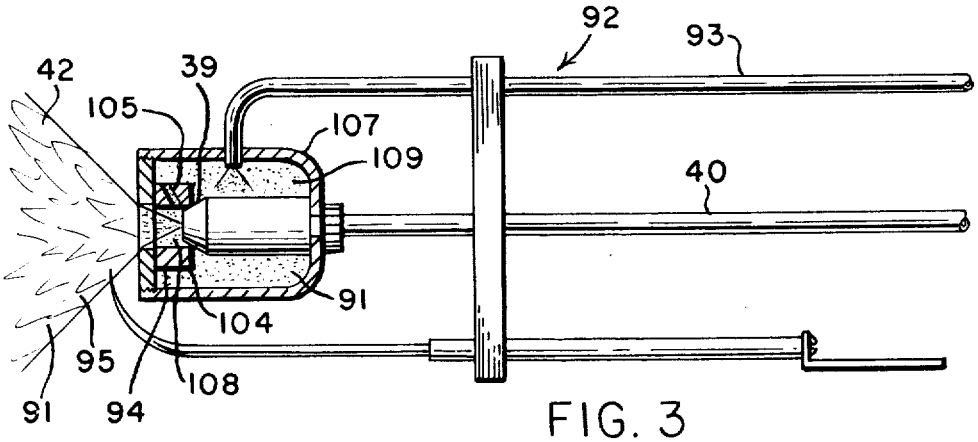
FIG. 3 is an enlarged fragmentary side elevational view of the firing unit of the invention.
Figure 4:
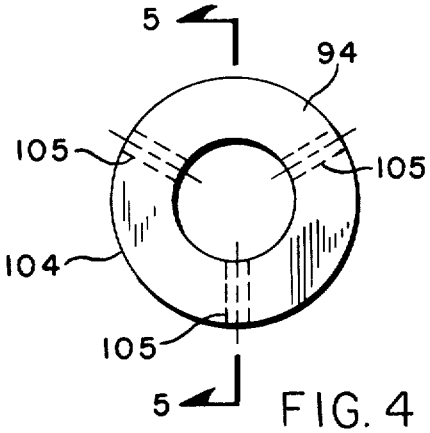
FIG. 4 is a plan view.
Figure 5:
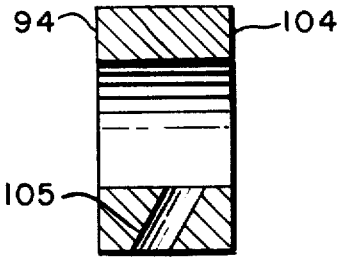
FIG. 5 a side elevation in half section of the vapor burner tip shown in FIG. 3.
Figure 6:
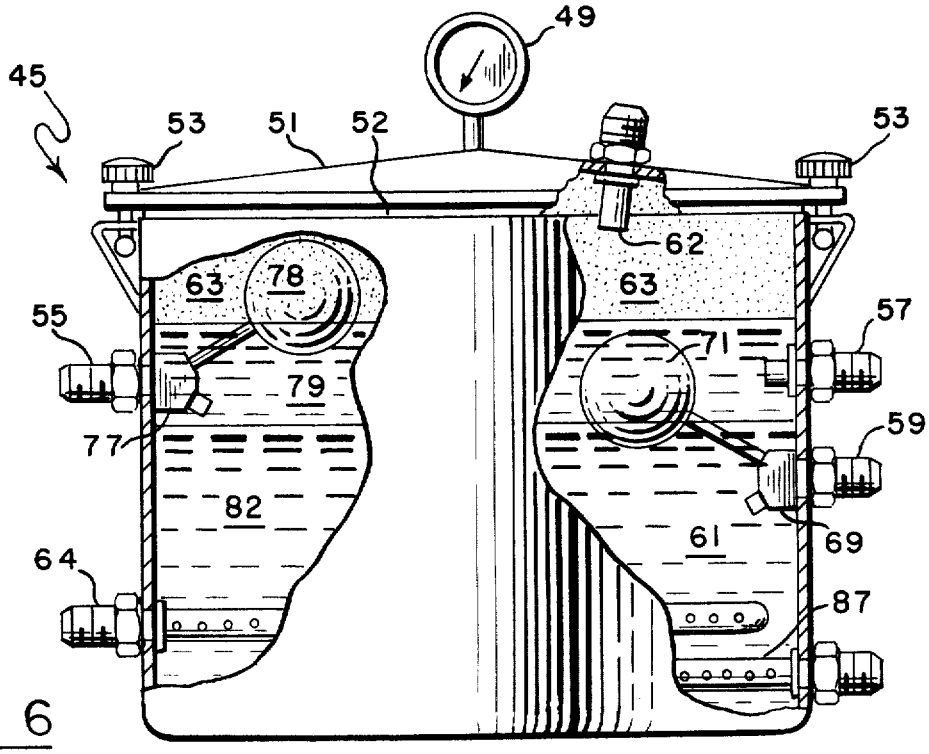
FIG. 6 is an enlarged side elevational view of the pressure tank of the invention.

As shown in FIGS. 3, 4 and 5 the vapor burner tip 94 is preferably in the form of a threaded nipple 104 having at least one orifice 105, and preferably three thereof as shown in FIG. 4. The preferred location for tip 94 is shown in FIG. 3 with the orifices 105 just below the level of the longitudinal centre line of burner tip 39.

I claim:

1. In a heating system of the type having a liquid fuel tank; a heating unit with a combustion chamber; a fuel burner with a liquid fuel pump and an atomized fuel burner tip within the combustion chamber; said pump feeding fuel from said tank to said tip, the combination of:

a pressure tank in said system, said tank having a liquid fuel inlet, a liquid fuel outlet, a water inlet and a vapor outlet in the upper portion thereof;

water supply means, connecting said water inlet to a water source to fill the lower portion of said tank with water;

automatic water control means for maintaining said water at a predetermined level within said pressure tank;

liquid fuel supply means connecting said liquid fuel inlet to said fuel tank and connecting said liquid fuel outlet to said pump and tip to fill the intermediate portion of said pressure tank with liquid fuel floating on said water;

automatic liquid fuel control means for maintaining said liquid fuel at a predetermined level;

vaporized, fuel formation means comprising a liquid fuel line leading from said liquid fuel supply means, in rear of said pump and in advance of said tip; said line including a coil in said combustion chamber, in the path of the flame therein, and a perforated tube, bubbler beneath the level of said water in said tank for creating liquid fuel bubbles rising through said water and said oil to form enriched vapor in the upper portion of said tank; and enriched vapor supply means including a vapor tip in said combustion chamber, a vapor conduit connecting said tip with the vapor outlet of said pressure tank, and air pressure supply means for maintaining predetermined pressure in said pressure tank.

2. A heating system as specified in claim 1, wherein: said enriched vapor supply means includes a motorized pump mounted on the exterior of said pressure tank.

3. A heating system as specified in claim 1, wherein: said enriched vapor supply means includes an air pump having an air inlet and having a perforated tube outlet in the bottom of said liquid fuel tank, closure seal means on said liquid fuel tank to form the same into a pressure tank and a conduit leading from the upper portion of said liquid fuel tank to the upper portion of said pressure tank.

4. A heating system as specified in claim 1, wherein: said automatic water control means comprises an electric circuit including a source of electromotive force, a pair of spaced apart electrodes in the lower portion of said pressure tank and an electrically operated valve in said water supply means, said circuit opening said valve to supply water to said tank in response to a signal from said electrodes.

5. A heating system as specified in claim 1, wherein: said automatic liquid fuel control means includes a float riding on the oil in said pressure tank and a valve actuated by said float to admit liquid fuel therein to a predetermined level and then to shut said valve.

6. A heating system as specified in claim 1, wherein: said fuel burner is of the gun type and said coil of said vaporized fuel formation means is mounted in said combustion chamber to encircle said burner gun as a jacket therearound.

7. A heating system as specified in claim 1, wherein: the flame produced by atomized fuel burner tip is generally conical in configuration and said vapor tip is located within the confines of said conically configured flame, in front of, and slightly below the level of, said burner tip.

8. The combination with an oil burner heating unit of a supplementary fuel supply system, said system comprising:

a pressure tank having a layer of water in the lower portion, a layer of oil floating on said layer of water in the intermediate portion and a vapor, or fume chamber in the upper portion;

enriched vaporized fuel formation means comprising a liquid fuel line leading from the oil burner of said unit through the combustion chamber of said unit to an outlet beneath the level of the water in said tank to produce heated oil bubbles therein for rising upwardly through said layers of water and oil into said vapor chamber enriched vaporized fuel supply means comprising a vapor burner tip in said combustion chamber, a vapor line connecting said tip to the vapor chamber of said tank and means for feeding said vapor under pressure to said vapor tip and air pressure supply means for maintaining predetermined air pressure in said pressure tank.

9. The method of increasing the heat produced by an oil burner heating unit by means of a pressure tank containing a layer of fuel oil floating on a layer of water which comprises the steps of:

periodically drawing liquid oil into said tank and pumping it to the burner tip of said unit while maintaining the thickness of said layer;

simultaneously pumping a diverted portion of said liquid oil from said burner through a heating coil in the combustion chamber of said unit and thence to an outlet beneath the level of said water in said tank to cause heated bubbling and turbulence therein and to form enriched vapor in the upper portion of said tank and simultaneously directing a pressurized flow of said enriched vapor from the upper portion of said pressure tank into said combustion chamber for ignition and flaming together with the flame from the tip of said burner.

10. Apparatus for burning fuel oil, said apparatus comprising a sealed, pressurized, water tank;

means for maintaining a layer of water in said tank at a predetermined level, means for supplying fuel oil into said tank, under said layer of water, to bubble up therethrough and form a layer of fuel oil, of predetermined depth, on said layer of water;

means for pre-heating said fuel oil, to a predetermined temperature, prior to its introduction into said water tank, so that hot oil bubbles mix with said water and form enriched combustible vapor in the top of said pressurized water tank, air pump means for feeding pressurized air into said tank to create predetermined pressure therein, and fuel line means for conducting said enriched vapor from the top of said sealed water tank into the flame of the oil burner in the combustion chamber of said apparatus.

11. Apparatus as specified in claim 10 wherein said air pump means includes a perforated nozzle within said tank, under the level of said water, for creating a large volume of air bubbling up through said water to mix with said enriched vapor.

12. Apparatus as specified in claim 10 wherein:

said oil pre-heating means includes an oil supply line with a coil in the combustion chamber of said apparatus, at least some of the convolutions of said coil, being in the path of the flame of the burner of said apparatus.

* * * * *